US005379659A

United States Patent [19]

Schrauwen et al.

[11] Patent Number: 5,379,659

[45] Date of Patent: Jan. 10, 1995

[54] METHOD FOR SETTING A SENSOR IN A WEB MOVEMENT CONTROL DEVICE

[75] Inventors: Hans J. Schrauwen, Tannenweg; Theodor Nacke, Milan Weg; Jürgen Bettführ, Jägerortstr, all of Germany

[73] Assignee: BST Servo-Technik GmbH, Germany

[21] Appl. No.: 16,018

[22] Filed: Feb. 10, 1993

[30] Foreign Application Priority Data

Feb. 11, 1992 [DE] Germany ..... 4203978

[51] Int. Cl.[6] ..... G01D 21/00; B23Q 15/00; B65H 43/00

[52] U.S. Cl. ..... 73/866.5; 226/10; 226/15

[58] Field of Search ..... 73/866.5, 865.8, 865.9, 73/159; 226/3, 10, 15, 16, 18, 19, 20

[56] References Cited

U.S. PATENT DOCUMENTS

| | | | |
|---|---|---|---|
| Re. 32,967 | 6/1989 | St. John et al. | 226/10 |
| 2,786,675 | 3/1957 | Monte Falco et al. | 226/20 |
| 3,567,091 | 3/1971 | Woblard | 226/18 |
| 3,568,904 | 3/1971 | Kurz | 226/15 |
| 3,682,362 | 8/1972 | Ott, Jr. | 226/21 |
| 3,786,974 | 1/1974 | Kron | 226/19 |
| 4,049,213 | 9/1977 | Hank et al. | 226/19 |
| 4,077,579 | 3/1978 | Seleski et al. | 226/20 |
| 4,291,825 | 9/1981 | Glanz | 226/18 |
| 4,331,274 | 5/1982 | Halewijn et al. | 226/15 |
| 4,848,632 | 7/1989 | Mack et al. | 226/18 |
| 4,860,964 | 8/1989 | Ishii et al. | 226/3 |
| 4,991,761 | 2/1991 | Gnuechtel et al. | 226/18 |
| 5,098,507 | 3/1992 | Mao | 226/16 |

FOREIGN PATENT DOCUMENTS

| | | | |
|---|---|---|---|
| 19246 | 2/1982 | Japan | 226/10 |

*Primary Examiner*—Hezron E. Williams
*Assistant Examiner*—Daniel S. Larkin
*Attorney, Agent, or Firm*—Austin R. Miller

[57] ABSTRACT

A method of adjusting the working point of a web movement control device beyond the measuring range of the sensor is disclosed.

2 Claims, 2 Drawing Sheets

METHOD FOR SETTING A SENSOR IN A WEB MOVEMENT CONTROL DEVICE

Figure 1:
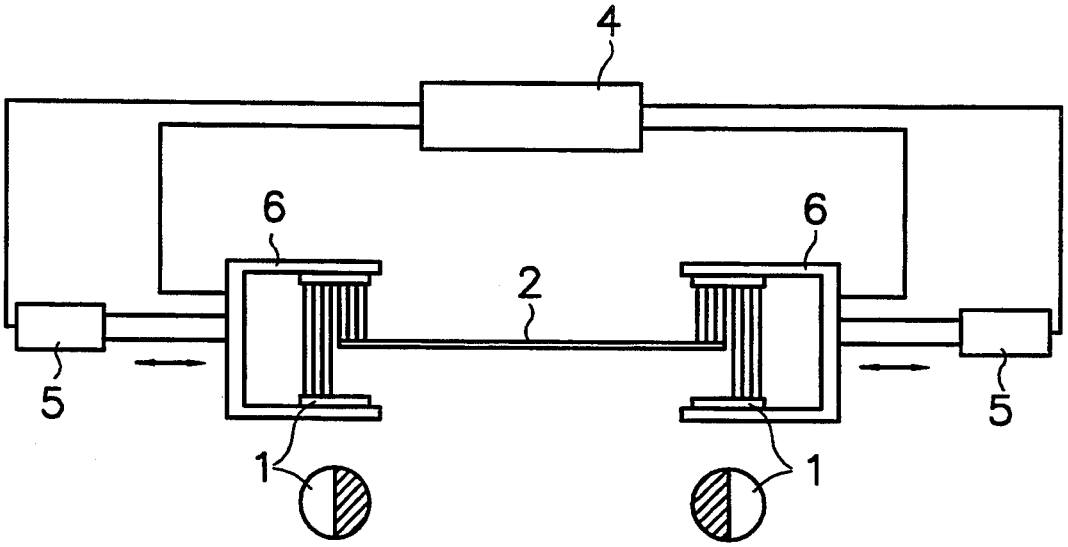
Figure 2A:
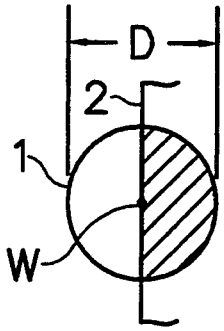
Figure 2B:
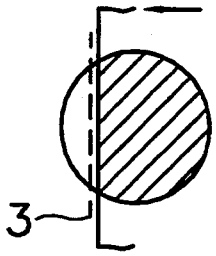
Figure 2C:
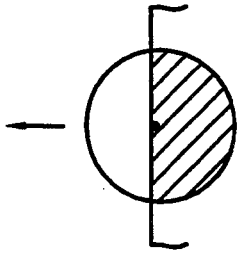
Figure 2D:
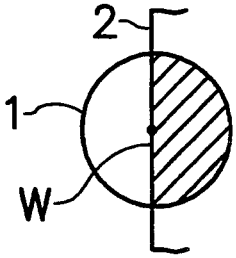

The invention relates to a method for setting a sensor in a web movement control device.

In a web movement control device in which the movement of the web is controlled by means of a sensor, for example a circular optical sensor, which detects the edge of the web in a contact-free manner, the working point of the control is specified at the center of the sensor so that with exact positioning of the sensor one half of the sensor is covered by the web to be controlled while the other half is uncovered. This working point is stored in a memory and web movement control is configured to this control variable (working point) so that in the case of a deviation of the edge of the web from the working point the web movement control adjusts the web via a control element in such a way that the edge of the web comes to lie again on the working point or the center of the sensor.

During operation, because of displacement of the web, it is sometimes necessary to adjust the working point of the controller. This takes place in that, via correction keys, the working point is adjusted inside the measuring range of the sensor, for example inside the diameter of a circular optical sensor, while the web movement control is running. This adjustment takes place in an electronic signal processing device which receives sensor signals and processes them for controlling web movement. Displacement of the working point can be performed very precisely by means of the correction keys since displacement of the working point takes place in the electronic signal processing device and not by mechanical adjustment of the sensor. However, such a displacement of the working point is only possible within the measuring range of the sensor.

If the working point is to be displaced beyond the measuring range of the sensor in a sensor with for example a diameter of 6 mm and thus a measuring range of 3 mm on each side of the center of the sensor, the sensor adjustment device has to be driven in order to adjust the sensor over a corresponding path. The sensor adjustment device operates relatively inaccurately and has a certain degree of after-running (i.e., movement subsequent to initiation of a stop command so that during this sensor adjustment the sensor is moved, for example, beyond the foreseen position. Then, the working point must be moved back by means of the correction keys and corrected in such a way that it corresponds to the desired position. This setting process when the working point is adjusted beyond the measuring range of the sensor is relatively laborious.

The invention is based on the object of devising a method that the working point of the controller can be easily and rapidly adjusted beyond the measuring range of the sensor.

This object is achieved according to the invention by means of the features in the characterising part of claim 1. A threshold in the electronic signal processing device is preset inside the measuring range of the sensor on each side of the center of the sensor or of the working point. A signal is emitted when the working point reaches the threshold during the customary working point adjustment by means of correction keys. On the one hand, web movement control can operate until it is switched off or blocked by the signal so that the edge of the web remains in the position it has reached. On the other hand, the sensor adjustment device is driven in such a way that it executes an edge search process by adjustment of the sensor, the sensor being positioned again with its center on the edge of the web by means of the accurate edge search process. Then, the web movement control is switched on again and the same process can be repeated until the working point of the control is located in the desired position which can lie far outside the measuring range of the sensor in the original position, to which, in the new position, the measuring range of the sensor is again available for a working point correction.

In this way, the working point of the control can be adjusted beyond the measuring range of the sensor without laborious setting measures.

The invention is explained in greater detail by way of example with reference to the drawings FIG. 1 shows schematically two sensors on both sides of a web of material and FIGS. 2*a*–2*d* shows a diagrammatic view of a sensor in its position relative to the edge of the web.

FIG. 1 shows a diagrammatic view of circular optical sensors 1 in a U-shaped holder 6, which can be adjusted by a sensor adjustment device 5, on the two sides of a web 2 of material, the edges of the web covering half of the sensors 1 in each case in this view. At the reference numeral 4, an electronic signal processing and control device is illustrated diagrammatically, which receives the sensor signals and processes them. In addition, the sensor adjustment device 5 for adjusting the holders 6 of the sensors 1 is controlled by control device 4.

In FIG. 2, the number 1 designates a circular optical sensor which is aligned in a first position a) with the center of sensor 1 on the edge of a web 2 of material to be controlled so that web 2 of material covers one half of the sensor, as is indicated by hatching. The center of the sensor is specified as the working point W for the control from the web movement so that in a deviation of the edge of web 2 from the control variable W=0 to the right or to the left of the center of sensor 1, signal processing device 4 which processes sensor signals for web movement control and for control of sensor adjustment device 5 drives a control element by means of which movement of web 2 of material is influenced in such a way that the edge 2 of the web 2 is aligned again with the center of the sensor 1 or the working point W.

If a displacement of the working point is to be performed, the working point W of sensor 1 is initially adjusted inside the measuring range D of sensor 1 by means of correction keys to the left of position a) whilst the web movement control is switched on so that the edge of web 2 is adjusted, following the working point, to the left inside the measuring range D, as is represented in position b).

A threshold 3 in electronic signal processing device 4 is preset still within the measuring range D of sensor 1, for example with 75% coverage of the sensor (i.e., set the threshold at approximately 50% of half of the measuring range D of sensor 1). If, during the adjustment in signal processing device 4, the working point reaches this threshold value to which the corresponding sensor signal with a dark value of for example 75% of the covered surface of sensor 1 corresponds, a signal is generated which, on the one hand, blocks or switches off web control so that the edge of web 2 remains in the position which has been reached and, on the other hand, sensor adjustment device 5 is driven by means of this signal in order to trigger a search process of sensor 1, during which process sensor 1 is moved to the left until its center (W=0) is again aligned with the edge of web 2, as is shown by position c). If, during this edge search process, sensor 1 cannot be exactly positioned with its center on the edge of web 2, the position which sensor 1 has reached relative to the edge of web 2 is set as a set value or is taken over as W=0. If, during the edge search process, the center of the sensor comes to lie for example at W=3 (i.e., at threshold 3) next to the edge of the web 2, this position of sensor 1 is taken over in signal processing device 4 as W=0 or set as the set value so that the web control continues to operate with this control variable. Thus, sensor 1 is not moved over the remaining amount but rather the position reached by the center of sensor 1 is set as the set value in signal processing device 4 so that overall accurate positioning can be achieved.

After this edge search process, the web movement control is switched on again and the working point of sensor 1 is adjusted again to the left inside the measuring range D by means of the correction keys if the working point displacement was still not adequate in the first step. If during this process threshold 3 is reached, the same process is repeated until for example a working point displacement, represented in position d), which lies outside the measuring range D of sensor 1 in the original position a).

During this adjustment of the working point, the working point is initially displaced relatively slowly inside the measuring range, after which, threshold 3 is reached, the edge search process is executed at increased adjustment speed by means of sensor adjustment device 5. In the working point displacement described, the edge of the web 2 is initially moved into sensor 1, after which sensor 1 follows the edge of the web 2. In the case of a displacement of the working point in the opposite direction, the edge of web 2 is initially moved out of sensor 1, after which sensor 1 follows the edge of web 2 and this incremental process is repeated.

In this way, a working point displacement over a large adjustment range can take place using a small sensor with a correspondingly small measuring range so that small, and thus cheap, sensors can be used where, hitherto, large, and therefore expensive sensors have had to be used because of the larger range of the working point displacement. A further advantage is that smaller sensors have a larger resolution so that, in addition, a higher degree of accuracy is achieved.

The method according to the invention for displacing the working point beyond the preset measuring range can be executed in the same way with sensors other than optical sensors, for example pneumatic sensors.

The described displacement of the working point can be performed with edge control and center control, sensors which are adjustable independently of one another being used in each case.

Since, in the edge search process, the center of the sensor or the working point can be exactly aligned with the edge of the web, a very accurate sensor position can be obtained using this method, an infinite adjustment of the working point being additionally possible by virtue of the displacement of the working point in the electronic signal processing device without the mechanical sensor adjustment influencing the positioning of the working point.

During correction of the working point by means of correction keys, the working point is slowly displaced within the measuring range, for example with a speed of change of 1 mm/sec, whilst in the edge search process sensor 1 is adjusted with an adjustment speed of for example 30 mm/sec. Here, the working point of the control can be infinitely displaced over the entire adjustment range of sensor 1 adjustment device 5 even if sensor adjustment device 5 only permits a fine adjustment for example 0.5 mm in the form of latches. This working point displacement can also be performed with a web center control which operates with sensors which are adjustable independently of one another.

We claim:

1. In a method for setting a sensor in a web sheet movement control device, wherein said sheet is subject to lateral movement from an initial position to a new edge position as it progresses in a forward direction, wherein the sensor has a measuring range and is moved by a sensor adjustment device onto and away from an edge of said sheet, said sensor adjustment device being controlled by an electronic signal processor in which sensor signals are processed, and wherein displacement of a working point inside said measuring range of the sensor is performable by the signal processor, the method comprising the steps of:

(a) presetting a threshold within the measuring range of the sensor around said working point in the center of said sensor in the electronic signal processor, (b) displacing said working point from the center in the electronic signal processor towards said threshold so that said control device moves said sheet laterally to follow said displaced working point, (c) stopping lateral movement of said sheet by stopping sheet movement control when the displaced working point is aligned with said threshold, (d) performing an edge search operation by moving said sensor toward said new edge position of said sheet by using said sensor adjustment device until the center of said sensor is aligned with said edge of said sheet, (e) starting sheet movement control and (f) repeating steps (a)–(e) if the desired setting of said sensor is not achieved.

2. The method according to claim 1, characterized in that the threshold is set at approximately 50% of half the measuring range of the sensor.

* * * * *